US007422132B2

(12) United States Patent
Laitio

(10) Patent No.: US 7,422,132 B2
(45) Date of Patent: Sep. 9, 2008

(54) VACUUM BELT CONVEYOR WITH LATERAL GUIDANCE FOR A WEB FORMING MACHINE

(76) Inventor: Juha Laitio, Töyrymäki 5, FIN-02760 Espoo (FI)

( * ) Notice: Subject to any disclaimer, the term of this patent is extended or adjusted under 35 U.S.C. 154(b) by 567 days.

(21) Appl. No.: 11/115,684

(22) Filed: Apr. 27, 2005

(65) Prior Publication Data

US 2005/0242148 A1 Nov. 3, 2005

(30) Foreign Application Priority Data

Apr. 29, 2004 (FI) ..... 20045156

(51) Int. Cl.
*B65H 20/00* (2006.01)
*B65H 23/24* (2006.01)

(52) U.S. Cl. ..... 226/97.3; 226/95; 226/19; 226/196.1; 242/615.11

(58) Field of Classification Search ..... 226/95, 226/97.3, 15, 18, 19, 196.1; 242/615.11; 271/276, 240, 248
See application file for complete search history.

(56) References Cited

U.S. PATENT DOCUMENTS 4,474,320 A * 10/1984 Rueger ..... 242/615.12
4,889,269 A * 12/1989 Long et al. ..... 242/615.12
5,915,613 A * 6/1999 Meschenmoser ..... 226/95
6,010,128 A * 1/2000 Loser et al. ..... 271/276
6,454,256 B1 * 9/2002 Boguhn et al. ..... 271/238
6,648,198 B2 * 11/2003 Demers ..... 226/95
2004/0244217 A1 12/2004 Ahvenainen et al.
2007/0119895 A1 * 5/2007 Pesch et al. ..... 226/95

FOREIGN PATENT DOCUMENTS

| | | |
|---|---|---|
| DE | 37 07 612 | 9/1988 |
| DE | 37 07 612 A1 | 9/1988 |
| DE | 200 01 082 | 5/2000 |
| DE | 200 01 082 U1 | 5/2000 |
| DE | 199 62 731 | 6/2001 |
| DE | 199 62 731 A1 | 6/2001 |
| DE | 100 50 848 | 4/2002 |
| DE | 100 50 848 A1 | 4/2002 |
| DE | 102 04 698 | 8/2003 |
| DE | 102 04 698 A1 | 8/2003 |
| FI | 112267 | 11/2003 |
| FI | 112267 B | 11/2003 |
| WO | WO 03/018909 | 3/2003 |
| WO | WO 03/018909 A1 | 3/2003 |

* cited by examiner

*Primary Examiner*—Evan H Langdon
(74) *Attorney, Agent, or Firm*—Stiennon & Stiennon

(57) ABSTRACT

A vacuum belt conveyor for a web forming machine intended for transporting a web threading tail (24) has lateral guidance. The vacuum belt conveyor has a frame construction (16) with two rolls (17, 18), an air-permeable belt loop (21) and guiding equipment (22) for providing lateral guidance. The guiding equipment (22) is composed of air blows (25), which are arranged on both sides of the web threading tail (24) and near the web threading tail (24) receiving end of the frame.

26 Claims, 3 Drawing Sheets

VACUUM BELT CONVEYOR WITH LATERAL GUIDANCE FOR A WEB FORMING MACHINE

CROSS REFERENCES TO RELATED APPLICATIONS

This application claims priority on Finnish App. No. 20045156, filed Apr. 29, 2004, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a vacuum belt conveyor equipped with lateral guidance for a web forming machine, the vacuum belt conveyor being intended for the transportation of a web threading tail and comprising a frame construction and at least two pulleys or rolls therein, an air-permeable belt loop arranged around the rolls, and guiding equipment for providing lateral guidance and thus for keeping the web threading tail on the vacuum belt conveyor, in which there is arranged a vacuum effect for the section of the belt loop transporting the web threading tail.

WO publication No. 03018909 sets forth a vacuum belt conveyor, in which, as in other known vacuum belt conveyors, the travel of the web threading tail on the surface of the belt loop is based on the friction force between the web threading tail and the belt loop. In addition, the friction force is proportional to the intensity of vacuum arranged inside the belt loop. In practice, increasing the vacuum increases the friction force, the direction of which is the same as that of the belt loop. In addition, the web threading tail and the belt loop usually have equal travel directions, in which case the web threading tail is not subjected to any cross-directional force. Consequently, the web threading tail can move in the cross direction relatively easily before being subjected to the returning cross-directional force caused by the deviation in the travel directions of the web threading tail and the belt loop.

Particularly in long belt conveyors, side walls are additionally used as guiding devices for keeping the web threading tail on top of the belt loop. In other words, the side walls are used to help prevent the cross-directional movement of the web threading tail. In practice, however, it has been noticed that the preventive and guiding effect of a side wall is insufficient for preventing the cross-directional movement irrespective of a high side wall. Furthermore, between the web threading tail and the side wall there remains an air layer such that the web threading tail curls up and typically rises upwards along the side wall. Consequently, the web threading tail is at least partly out of the range of the vacuum effect and also otherwise in an incorrect position with respect to the frame structure. This may lead to failed tail threading or at least to malfunctions. Side walls also collect loose material and affect disadvantageously the travel of the web threading tail also in other ways without performing however in a planned way. On the other hand, belt conveyors are used without side walls as well, in which case the previously mentioned problems are avoided, but at the same time even the slight guiding effect of the side walls is lost.

SUMMARY OF THE INVENTION

The object of the invention is to provide a new type of vacuum belt conveyor equipped with lateral guidance for a web forming machine, which avoids the drawbacks of the prior art technique. The vacuum belt conveyor according to the invention uses active guiding equipment for keeping the web threading tail in a desired position in the cross direction. In addition, the performance and efficiency of the guiding equipment can be adjusted, thus providing a more functional tail threading device. The effect of employing the guiding equipment on the performance and efficiency of the belt loop is real, and contributes to keeping the vacuum belt conveyor clean. Furthermore, the guiding equipment can be simply attached to existing vacuum belt conveyors, which can solve tail threading problems that have been experienced in the past. The guiding equipment according to the invention can be used for accurate positioning of the web threading tail or at least for restricting reliably its movement in the lateral direction, which is extremely advantageous as regards tail threading.

The invention is described below in detail by making reference to the enclosed drawings, which illustrate some of the embodiments of the invention.

DESCRIPTION OF THE PREFERRED EMBODIMENTS

Figure 2:
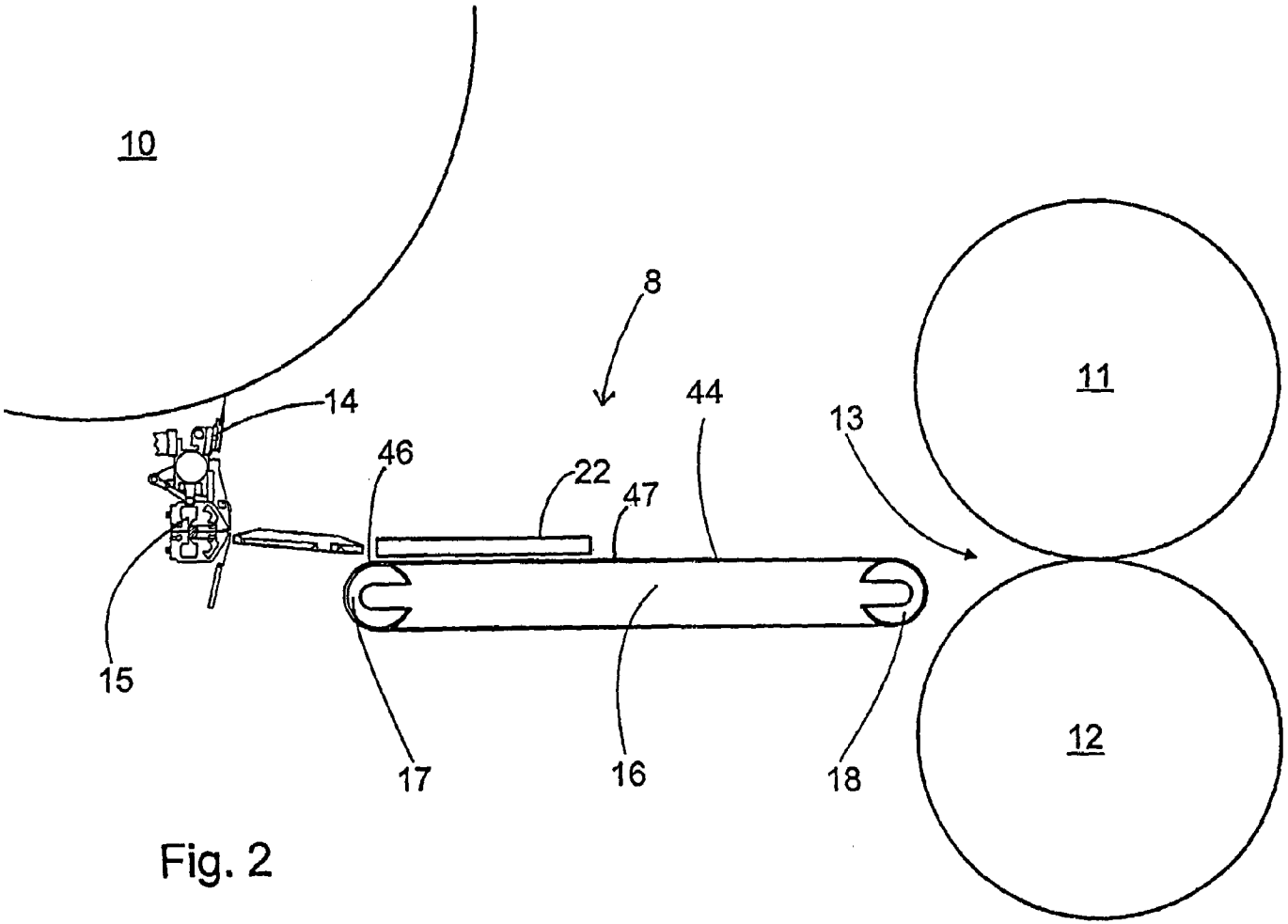
FIG. 2 is a principal drawing of a vacuum belt conveyor according to the invention arranged in a web forming machine.
Figure 3:
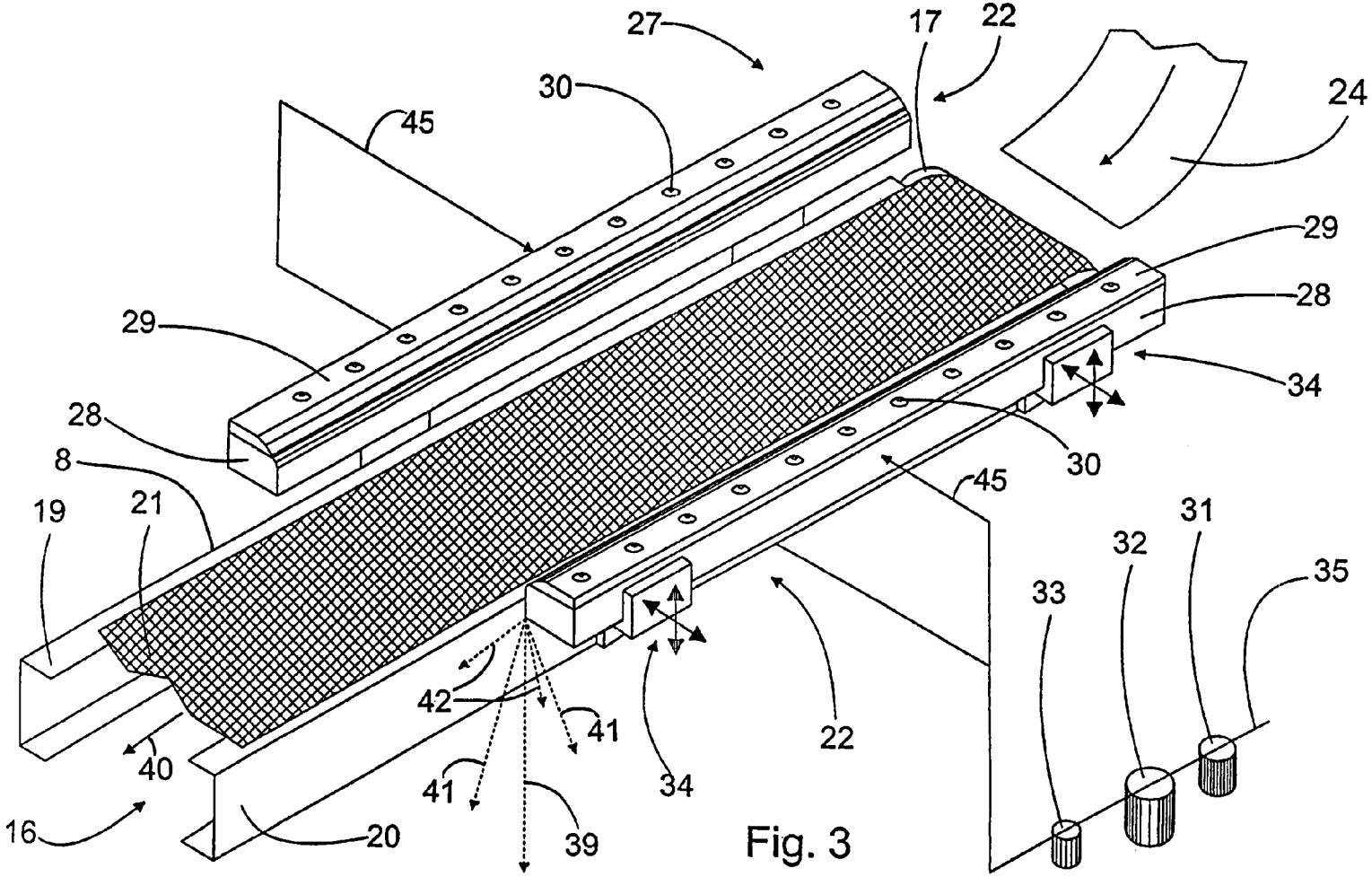
FIG. 3 is a principal drawing of a vacuum belt conveyor according to the invention, seen obliquely from above.

The vacuum belt conveyor 8 according to the invention is used particularly for transferring and guiding the web threading tail in paper, board and other similar web forming machines. The vacuum belt conveyor, hereinafter simply the "conveyor", can be integrally mounted to a web forming machine, or it can be made turnable using pivots. FIG. 2 shows one conveyor according to the invention, with which the web threading tail is arranged to be transferred from a dryer 10 to a roll nip 13 formed between two rolls 11 and 12. The web threading tail 24, shown in FIG. 3, is first run down using a doctor 14, and simultaneously cut with cutter 15 when the tail threading procedure is started, followed by leading the cut end to the conveyor 8. In some embodiments the web threading tail can be detached from the dryer surface on a conveyor, the first roll of which is underpressurized. In this case the doctor 14 and the cutting device 15 shown in FIG. 2 are not needed. In the embodiment of FIG. 2 the web threading tail is led to the roll nip 13 with the conveyor 8, but the destination can also be for example a rope nip or the following tail threading device. The conveyor 8 can also be preceded by another similar conveyor or some other type of tail threading device.

The main components of the conveyor are a frame construction 16 and at least two rolls 17 and 18 therein. As shown in FIG. 3, the frame construction 16 is mainly composed of side plates 19 and 20, which are supported to each other with suitable constructions (not shown). The conveyor is additionally provided with an air-permeable belt loop 21, which is arranged around the rolls 17 and 18. As shown in FIG. 2, a section 44 of the belt loop on a web transport side 47 of the conveyor 8, transporting the web threading tail 24, is provided with a vacuum effect, which is used to bring the web threading tail in contact with the belt loop. In this way the web threading tail can be controllably transported forward by rotating the belt loop. The interval between the side plates is open, which allows the vacuum arranged inside the frame construction to extend to the web threading tail through the belt loop. Air flow is illustrated with arrows 37 in FIGS. 1*a* and 1*b*. In practice, the belt loop is usually an air-permeable fabric. A vacuum can be generated inside the belt loop, to form a source of vacuum by means of a suction box 36, Coanda air blows or foil blades, for example. If the entire frame construction is under pressurized, the interval between the side walls is closed from below the frame construction for directing the vacuum effect to the upstream section of the belt loop. When using a vacuum box and foil blades, the bottom part of the frame construction can be open as shown in FIGS. 1*a*, 1*b* and 3.

Figure 1A:
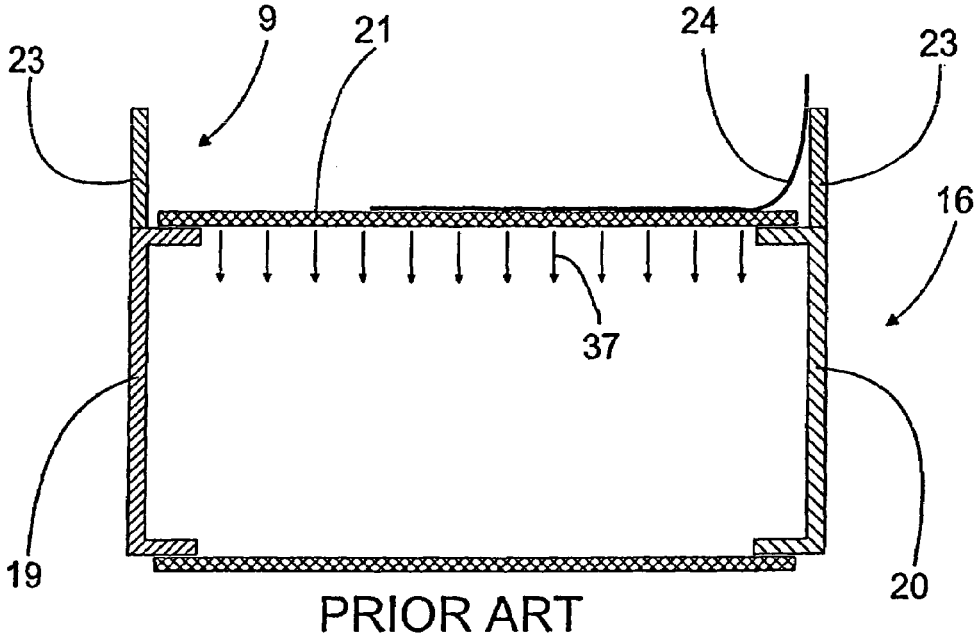
FIG. 1*a* is a cross-sectional view of a known vacuum belt conveyor.
Figure 1B:
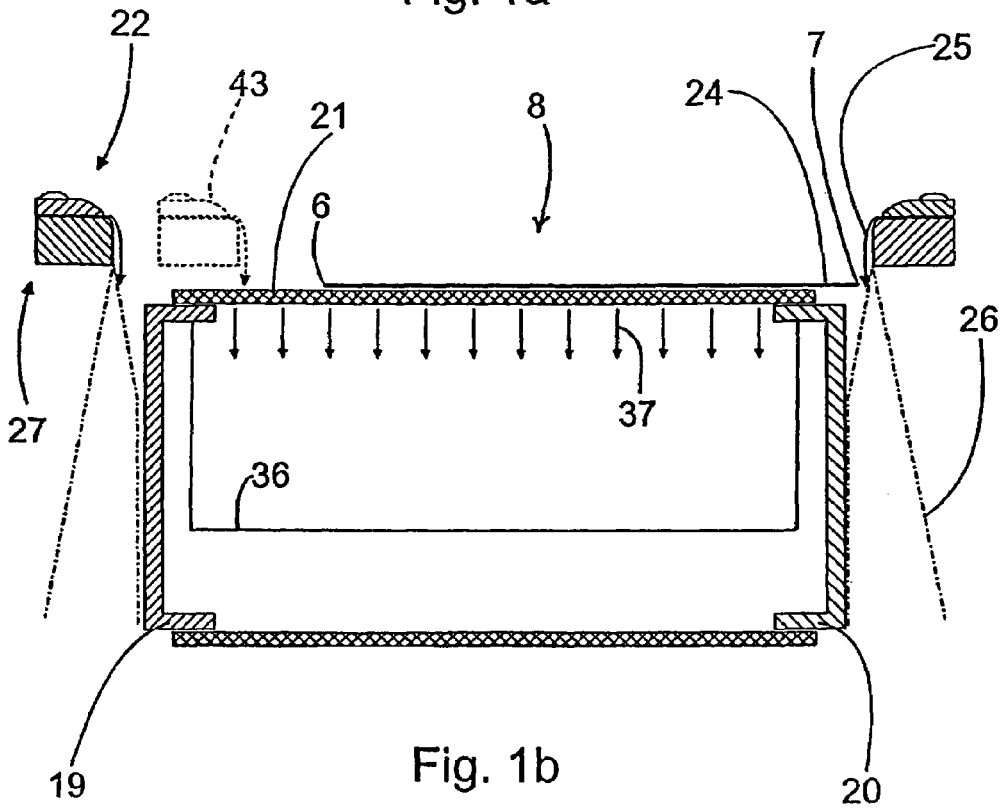
FIG. 1*b* is a cross-sectional view of a vacuum belt conveyor according to the invention.

FIG. 1*a* is a cross-sectional view of a conveyor according to the prior art technique. For keeping the web threading tail 24 on the conveyor, lateral guidance is used, which is implemented with guiding equipment 9. In the prior art technique, passive side walls 23, fastened to the frame construction 16, are used as guiding equipment 9. In FIG. 1*a* the side walls 23 are fastened to the side plates 19 and 20, which are made of a U-shape profile for increasing the rigidity of the frame construction 16. FIG. 1*a* shows a problem situation occurring in practice, in which the web threading tail 24 rises up along the side wall 23. In the worst case the end of the web threading tail completely drops off the conveyor, in which case tail threading must be restarted. Functionally similar parts are referred to using identical reference numbers.

According to the invention, guiding equipment 22 is composed of air blows 25, which are arranged on both sides 6, 7 of the web threading tail 24 and on the web threading tail receiving end 46 of the frame construction 16. In other words, air blows touching the frame construction are used to form an obstacle in the edge areas of the conveyor, thus allowing control of the web threading tail. Thus the obstacles formed by guiding equipment 22 are active. Air blows transfer the web threading tail that comes into their range of influence back to the belt loop, which allows returning the web threading tail quickly back to the correct position. Air blowing influences mainly the web threading tail entering the belt loop only. The air blows are additionally arranged essentially perpendicular to the belt loop 21. Consequently, the air blows push the web threading tail to the opposite direction compared to the direction to which the edge of the web threading tail would rise when curling up. On the other hand, the web threading tail keeps plane due to the effect of the vacuum until to the belt loop edge, which contributes to preventing the curling up of the web threading tail edge. In FIG. 3 the air blows are essentially perpendicular to the belt loop. In practice, the air blows can however be turned relative to their longitudinal axis or, by using individual nozzles, air blowing can also be partly guided towards or against the travel direction of the web threading tail. In other words, air blows can be turned about their longitudinal axis, in which case air blowing is directed more towards the center line of the belt loop or correspondingly, away from the belt loop. On the other hand, different nozzles can also be used to direct air blowing forward or backward relative to the belt loop travel direction. In practice, it is possible to use either or both of these orientations at the same time. In FIG. 3, illustrated with a long broken-line arrow 39, perpendicular air blowing is depicted, which is perpendicular both to the belt loop 21 and to its travel direction 40. Likewise, using the medium long broken-line arrows 41 it is depicted how air blowing is turned relative to the belt loop travel direction 40. Turning the air blows relative to their longitudinal axis is illustrated with short broken-line arrows 42. By using both guiding methods, the directional vector of the air blows is the resultant of the two above presented arrows (not shown). In FIG. 3 the arrow lengths are different for distinguishing them from each other. Thus here the length of the arrow does not illustrate the intensity of air blowing.

The web threading tail is most prone to moving in the lateral direction just when arriving at the conveyor. According to the invention, the air blows are in fact arranged at the first end of the vacuum belt conveyor 8 in the travel direction of the belt loop. In this way the web threading tail can be made to calm down on the belt loop, where it remains until to the other end of the conveyor. In principle, air blowing can be provided using several adjacent nozzles. In this case the air blows on both sides of the frame construction form a uniform air curtain, which is in its lateral direction arranged to the longitudinal direction of the frame construction. The air curtain 26 forms an active obstacle which accurately controls the web threading tail.

Air discharging from several individual nozzles may create an air blow that disturbs the travel of the web threading tail. According to the invention, the conveyor comprises two air knives 27, one on each side of the web threading tail 24, for forming the air curtains 26. This provides a uniform and laminar air curtain, which is additionally precisely bounded and without turbulence. FIG. 3 shows only a part of the conveyor according to the invention. In short conveyors the distance between the rolls is approximately 300-500 mm, but the longest belt conveyors can be as long as two meters. In practice, the length of the air knife 27 is at least 200 mm and it is arranged to extend from the first roll 17 in the travel direction 40 of the belt loop. After this distance the possible lateral movement of the web threading tail is eliminated, which allows keeping the web threading tail on the belt loop until to the end. In this case air knives extending over the entire length of the conveyor are unnecessary. On the other hand, lateral guidance can be required in the entire transporting section of the belt loop, in which case the length of the air knife is equal to or even slightly longer than that of the conveyor for forming an extensive air curtain. Full-length air knives can also be used for example for preventing disturbing air flows from the environment from extending to the web threading tail.

Individual pipe and/or slit nozzles can also provide a functional air curtain by using suitable air blow orientation and/or a suitable guiding surface. Air blows are located particularly in the area in which the web threading tail arrives at the belt loop surface. As tail threading proceeds, this area however often changes as the web threading tail tightens on the belt loop. In practice, this area moves on the belt loop forwards in its travel direction. Thus the guiding equipment must be essentially located in the entire belt loop area to which the web threading tail arrives for the whole desired active guiding time. Depending on the application and particularly in tail threading operations comprising several successive conveyors, some conveyors are provided with guides over the entire length or only over a partial distance.

The proposed air knife 27 comprises a shaped blow beam 28 and a cover 29, with an adjustable nozzle opening in-between. In practice air flows along the surface of the blow beam turning simultaneously downwards. This results from the Coanda effect, which aspirates a great amount of surrounding air creating an air curtain with a high speed and volumetric flow. In addition, the air curtain extends over the entire length of the blow beam and it is precisely bounded. In FIG. 1*b* the flow pattern of the air curtain 26 is illustrated with dot-and-dash lines.

The proposed air knife performs best with compressed air, for which the blow beam is fitted with at least one connection 45 shown schematically in FIG. 3. Usually air knives with a length exceeding 600 mm are fitted with two connections for providing a uniform air blow. According to the invention, the air knife is arranged such that the speed of air blow is at least 25 m/s. In this case it can be ensured that the efficiency of the air knife is sufficient for providing the hindering effect. The operation of the air knife can be adjusted in several different ways. Firstly, between the blow beam 28 and the cover 29 there is a replaceable adjustor plate (not shown), which can be replaced by loosening first the screws 30. Usually the nozzle opening is approximately 0.05-0.1 mm. Because of this the compressed air channel 35 is usually fitted with a filter 31 and an oil remover 32. Furthermore, the air knife 27 can be adjusted by changing the setting of the pressure regulator 33. For example, at a pressure of 1.4 bar and with a nozzle opening of 0.05 mm, the speed of air flow is 15 m/s. Correspondingly, the speed is as high as 50 m/s at a pressure of 5.5 bar. In addition, the design of the blow beam, for example, can be used to influence the characteristics of air blowing. In practice, when increasing the Coanda radius of the blow beam, the blow opening must also be increased, which allows raising the pressure used.

The above-described means are mainly for adjusting the air knife. For adapting the distance of the blow beam 28 in both vertical and lateral directions relative to the frame construction 16, there are control elements 34 arranged between the frame construction 16 and the blow beam 28. The movement directions of the control elements 34 are illustrated with arrows in FIG. 3. To these control elements, it is also possible to connect, for example, turning of the air knife about its longitudinal axis. Screw connections equipped with links represent the simplest design of the control elements. Using these control elements the air knives can be attached to existing conveyors. The operation of the conveyor has been tested with different settings. In practice, the distance of the blow beam according to the proposed embodiment from the frame construction is 5-100 mm in the vertical direction, more preferably 20-50 mm, and 0-50 mm in the lateral direction. Generally air blowing is thus in the lateral direction outside the web threading tail on both of its sides. In the examples shown the air blows are outside the frame construction as well. In this case air blows can be freely discharged downwards with the air curtain still forming an active obstacle. If desired, it is possible to arrange a support construction undisturbing to the air passage in the space between the frame construction and the guiding equipment, such as a net, to serve as an obstacle for the web threading tail in case of possible air blow disturbances, for example. On the other hand, in the tests the space between the air blows was only slightly wider than the web threading tail, in which case the provided lateral guidance efficiently prevented even relatively small fluctuations of the web threading tail. In addition, it was noticed that the blow air created by the narrow jet of the air knife was removed by means of the internal vacuum equipment of the belt conveyor without disturbing the operation of the belt loop, although the air knife 43 had been set on top of the belt loop. Hence, the air knife can be set even on top of the belt loop, which is illustrated by the broken-line air knife 43 in FIG. 1*b*. Generally the air blows are arranged to start from the web threading tail side of the frame construction, usually from above the belt loop. That is, the direction of air blowing is mainly the same as the direction of the vacuum effect shown by arrows 37 in FIG. 1*b*.

With the conveyor according to the invention the web threading tail can be securely maintained on top of the belt loop. In addition, the air knives and their operation can be easily adjusted and retrofitting is also easy. An essential fact is also a formation of active lateral guidance with air blows, which prevent the web threading tail from escaping from the conveyor.

The invention claimed is:

1. A vacuum belt conveyor equipped with lateral guidance for a web forming machine, the vacuum belt conveyor having a web transport side for transportation of a web threading tail, comprising:

a frame having a first side and a second side;

at least two rolls mounted for rotation to the frame;

an air-permeable belt forming a loop around the at least two rolls and arranged for movement on the at least two rolls to form the vacuum belt conveyer;

wherein a section of the belt loop is arranged to transport a web threading tail;

wherein the section of the belt loop defines the web transport side of the vacuum belt conveyor and defines a plane;

a source of vacuum arranged to draw air in a first direction, through the section of the belt loop arranged to transport the web threading tail; and air blows arranged on the first and second sides of the frame adjacent the web transport side of the vacuum belt conveyor, the air blows providing lateral guidance for keeping the web threading tail on the vacuum belt conveyor;

wherein the air blows are spaced from and positioned above the web transport side of the vacuum belt.

2. The apparatus of claim 1, wherein the air blows are arranged to blow substantially perpendicular to the plane defined by the section of the belt loop.

3. The apparatus of claim 1, wherein the air blows are arranged at a first end of the vacuum belt conveyor which is arranged to receive the web threading tail.

4. The apparatus of claim 1, wherein each of the air blows has a continuous slot forming a nozzle, wherein the nozzles are arranged to form uniform air curtains, which extend along the frame first side and second side.

5. The apparatus of claim 4, wherein the air blows comprise a first air knife and a second air knife for forming the air curtains.

6. The apparatus of claim 5, wherein the first air knife and the second air knife are at least 200 mm long and the first air knife extends along the frame first side from a first end of the vacuum belt conveyor which is arranged to receive a web threading tail and the second air knife extends along the frame second side, from the first end of the vacuum belt conveyor which is arranged to receive a web threading tail.

7. The apparatus of claim 5, wherein each air knife is connected to a compressed air source of a selected pressure, and has a nozzle of a selected width to produce a speed of at least 25 m/s in blowing air flowing from the nozzle.

8. The apparatus of claim 1, wherein the air blows comprise two air knives for forming air curtains, and wherein each air knife comprises a shaped blow beam and a cover mounted to the blow beam, and having a nozzle forming an adjustable opening therebetween.

9. The apparatus of claim 1, wherein the air blows are formed by shaped blow beams and arranged between the frame and blow beam there is adjustment equipment for changing the distance of the blow beam in both a vertical and a lateral direction relative to the frame.

10. The apparatus of claim 1, wherein the air blows are formed by shaped blow beams and the distance of each blow beam from the frame is 5-100 mm in the vertical direction, and 0-50 mm in the lateral direction.

11. The apparatus of claim 10, wherein the distance of each blow beam from the frame is 20-50 mm in the vertical direction.

12. The apparatus of claim 1, wherein the air blows are formed as continuous air knives of at least 200 mm long.

13. The apparatus of claim 1, wherein the air blows are arranged to blow with at least a component of a directional vector of the air blows in the first direction in which air is drawn through the web transport side of the vacuum belt.

14. The apparatus of claim 1, wherein the air blows are formed by nozzles directed parallel to the web transport side of the vacuum belt, wherein each nozzle is formed by a shaped blow beam and a cover mounted to the blow beam and arranged so that air from the nozzles flows along the surface of the blow beam and turns downwards under the Coanda effect toward the web transport side of the vacuum belt.

15. A method of guiding a web threading tail on a vacuum belt conveyor, comprising the steps of:

supplying the web threading tail to an air-permeable vacuum belt, wherein the air-permeable vacuum belt rotates on a plurality of rolls mounted to a frame;

poviding lateral guidance for keeping the web threading tail on the vacuum belt conveyor by blowing air from air blows on each side of the web to actively constrain the web tail to the vacuum belt; and keeping the web threading tail planar and attached to the vacuum belt by drawing vacuum through the vacuum belt; and changing the distance of the air knives in both a vertical and a lateral direction relative to the frame.

16. The method of claim 15 wherein the air blows blow air with a speed of at least 25 m/s.

17. The method of claim 15, wherein the air blows blow air substantially perpendicular to the belt loop at a speed of at least 25 m/s.

18. The method of claim 15, wherein the step of blowing air from the air blows on each side of the web to actively constrain the web tail to the vacuum belt includes blowing air with at least a component of the directional vector toward the web transport side of the vacuum belt.

19. The method of claim 15, wherein the step of blowing air from air blows further comprises blowing air between a blow beam and a cover mounted to the blow beam so that air flows along the surface of the blow beam and turns downwards under the Coanda effect toward the vacuum belt.

20. A vacuum belt conveyor equipped with lateral guidance for a web forming machine, comprising:

a web threading tail, having a first side and a second side spaced in a cross-machine direction from the first side;

a frame construction having a first side and a second side spaced in the cross-machine direction from the first side;

two rolls mounted for rotation to the frame;

an air-permeable belt forming a loop around the two rolls and arranged for movement on the two rolls to form a vacuum belt conveyer;

a means for drawing in a first direction, a vacuum on a section of the belt loop arranged to transport the web threading tail;

wherein the section of the belt loop defines a web transport side of the vacuum belt conveyor, and defines a plane;

wherein the web threading tail comes into engagement with the web transport side of the vacuum belt conveyor; and air blows arranged on the first side and the second side of the web threading tail where it engages the web transport side of the vacuum belt conveyor, the air blows arranged to provide side to side guidance for keeping the web threading tail on the web transport side;

wherein the air blows are spaced from and positioned above the web transport side of the vacuum belt.

21. The apparatus of claim 20, wherein the air blows are arranged to blow substantially perpendicular to the plane defined by the section of the belt loop.

22. The apparatus of claim 20, wherein the air blows are air knives having a continuous slot forming a nozzle arranged to form uniform air curtains, which extend along the frame first side and second side.

23. The apparatus of claim 22, wherein the length of the air knives is at least 200 mm and the air knives extend along the frame first side and frame second side.

24. The apparatus of claim 20, wherein each air blow comprises a shaped blow beam and a cover mounted to the blow beam, and having a nozzle forming an adjustable opening therebetween.

25. The apparatus of claim 20, wherein the air blows are arranged to blow with at least a component of a directional vector of the air blows in the first direction in which air is drawn through the web transport side of the vacuum belt.

26. The apparatus of claim 20, wherein the air blows are formed by nozzles directed parallel to the web transport side of the vacuum belt, wherein each nozzle is formed by a shaped blow beam and a cover mounted to the blow beam and arranged so that air from the nozzles flows along the surface of the blow beam and turns downwards under the Coanda effect toward the web transport side of the vacuum belt.

* * * * *

UNITED STATES PATENT AND TRADEMARK OFFICE

CERTIFICATE OF CORRECTION

PATENT NO. : 7,422,132 B2
APPLICATION NO. : 11/115684
DATED : September 9, 2008
INVENTOR(S) : Juha Laitio It is certified that error appears in the above-identified patent and that said Letters Patent is hereby corrected as shown below:

Title Page insert -- (73) Assignee: METSO PAPER, INC., Helsinki, FI --.

Signed and Sealed this

First Day of September, 2009

David J. Kappos

David J. Kappos
*Director of the United States Patent and Trademark Office*